US009147537B1

(12) United States Patent
Kowalik

(10) Patent No.: US 9,147,537 B1
(45) Date of Patent: Sep. 29, 2015

(54) DOUBLE BREAK DISCONNECT SWITCH

(71) Applicant: Peter M. Kowalik, Trafford, PA (US)

(72) Inventor: Peter M. Kowalik, Trafford, PA (US)

(73) Assignee: CLEAVELAND/PRICE INC., Trafford, PA (US)

( * ) Notice: Subject to any disclaimer, the term of this patent is extended or adjusted under 35 U.S.C. 154(b) by 327 days.

(21) Appl. No.: 13/941,463

(22) Filed: Jul. 13, 2013

Related U.S. Application Data

(63) Continuation-in-part of application No. 13/651,398, filed on Oct. 13, 2012, now Pat. No. 8,916,785.

(51) Int. Cl.
*H01H 31/30* (2006.01)
*H01H 31/20* (2006.01)

(52) U.S. Cl.
CPC ..... *H01H 31/20* (2013.01)

(58) Field of Classification Search
CPC ..... H01H 31/00; H01H 31/28; H01H 31/283; H01H 31/20; H01H 31/30
USPC ... 200/48 R, 48 A, 48 P, 48 KB, 48 V, 48 SB, 200/48 CB
See application file for complete search history.

(56) References Cited

U.S. PATENT DOCUMENTS

| | | | | |
|---|---|---|---|---|
| 1,695,868 | A | 12/1928 | Stolz | |
| 2,810,799 | A | 10/1957 | Carmichael et al. | |
| 3,134,865 | A | 5/1964 | Bernatt | |
| 4,078,162 | A | 3/1978 | Turner | |
| 5,483,030 | A * | 1/1996 | Bridges | 218/12 |
| 7,091,431 | B1 * | 8/2006 | Arcand et al. | 200/48 R |
| 8,829,372 | B1 * | 9/2014 | Rhein | 200/48 SB |
| 8,916,785 | B1 * | 12/2014 | Kowalik | 200/48 R |

* cited by examiner

*Primary Examiner* — Marina Fishman
(74) *Attorney, Agent, or Firm* — Ronald S. Lombard

(57) ABSTRACT

A double break disconnect switch including a bearing arrangement carrying a switch blade assembly is mounted on a drive arrangement. The switch blade assembly is rotatable longitudinally during initial opening and final closing of the switch and transversely for final opening and initial closing. The switch blade assembly is hinged for rotation about a hinge axis offset from the center of gravity of the switch blade for initial opening and for final closing. A blade bearing is provided of very small in diameter. The drive assembly uses the weight of the blade to keep the blade from rotating longitudinally and uses a cam arrangement including a roller riding in a slot of a blade drive plate that is spring loaded on one end and pivotally attached at the other end to rotate the blade longitudinally providing greater force to rotate the blade as contacts engage.

14 Claims, 12 Drawing Sheets

CLOSED

OPEN

DOUBLE BREAK DISCONNECT SWITCH

CROSS-REFERENCE TO RELATED APPLICATION

This application is a continuation-in-part application of and claims the benefit of pending U.S. patent application Ser. No. 13/651,398 filed Oct. 13, 2012. The said U.S. patent application Ser. No. 13/651,398 is herein incorporated by reference in its entirety as though fully set forth.

BACKGROUND OF THE INVENTION

The invention relates generally to a double break disconnect switch for high voltage applications and, more particularly, to a double break disconnect switch having fixed jaws and a switch blade assembly having a macro swinging movement relative to the jaws and arranged for a rotational movement with respect to its longitudinal axis upon contact with the fixed jaws to effect closing and opening of the switch.

High voltage switches of this type customarily employ round tubular blades which rotate on their long center axis to achieve the contact pressure developing or relieving for opening or closing of the switch. Because of restrictions to movement that may develop because of causes such as ice build up between the fixed jaws and the switch blade assembly or debris large forces are often necessary to initially open or finally close the switch.

Many such switches on the market today employ arrangements such as a beveled gear approach for rotational movement of the switch blade assembly with respect to its longitudinal axis. Such an arrangement is disclosed in U.S. Pat. No. 2,810,799 issued to Robert D. Carmichael, et al. on Oct. 22, 1957. The Carmichael device uses cooperating gear teeth for rotation of the switch blade about its longitudinal axis with a spring bias. Another switch using a different arrangement for rotation of the switch blade assembly with respect to its longitudinal axis is disclosed in U.S. Pat. No. 3,134,865 issued to Joseph Bematt on May 26, 1964. The Bematt device discloses a switch using a pressure member to engage a V-shaped cam which includes circular detents to lock the blade assembly in desired position. And still another such switch arrangement is disclosed in U.S. Pat. No. 4,078,162 issued to John L. Turner on Mar. 7, 1978. The Turner switch utilizes a blade lock that uses a pivotally mounted latch on a remote terminal at the switch jaw which includes a hook-like portion spring biased downwardly into latching position with respect to the end portion of the blade and is rotatable out of latching position by engagement with the latch of an arm carried by the blade when the contact lug is rotated out of engagement with the remote terminal and is formed with an extension engageable with the blade mounted latch operating arm for opening the latch as the blade approaches closed position. Yet another such switch arrangement is disclosed in U.S. Pat. No. 1,695,868 issued to Joseph Stolz on Dec. 18, 1928. The Stolz switch uses an operating mechanism which includes a pair of upright perforated lugs with an inclined face formed on a plate carried by a rotating insulator which engages lugs on a sleeve that surrounds the blade to cause rotation of the blade about its longitudinal axis.

Although the foregoing arrangements are functional there still exists a need and it is therefore an object of this invention to provide an optimized arrangement for rotational movement of the switch blade assembly with respect to its longitudinal axis.

SUMMARY OF THE INVENTION

The present invention provides a double break disconnect switch with a novel drive mechanism that provides the ability for precise and adjustable operating force as the switch blade closes into the break jaws to ensure that no rotation of the switch blade about its rotational axis occurs prior to a significant and pre-set force being applied to the blade tips as the switch blade tips close against the break jaws. After this force level has been reached, a quick release occurs of the switch blade dropping the force to a much lower value thereby permitting easy rollover of the switch blade as it engages the break jaws. It has been found that this sequence of high force dropping to low force is important to have an easy to operate but highly reliable closure of the switch, especially where icy conditions may be of concern.

One aspect of the invention provides a double break disconnect switch where the rotation of the center insulator swings the blade open and dosed in a conventional manner by movement of a lever about a vertical axis K but the rotation with respect to the blades longitudinal axis is unique. This mechanism uses a unique cam arrangement to rotate the blade about a hinge axis L. Also, the blade bearings are offset from the blade center of gravity so as to use the blade's weight to keep the blade in the position of disengagement with the break jaw contacts when the switch is opened. Also these bearings are very small in diameter which reduces friction to make the switch operate with substantially less force. Since the blade bearings are not around the diameter of the blade, the friction does not increase as current rating increases due to larger blade diameters. Additionally, the camming mechanism is profiled to give maximum rotational torque to the blade as it compresses the contact fingers as the switch closes to its final closed position. A further advantage of this design is the structure that allows the blade to move vertically within pivot points to better align the blade contacts with the break jaw contacts.

The blade is hinged for rotation with a predetermined minimum torque about the longitudinal hinge axis L which is positioned outside the outer surface of the blade and parallel to the longitudinal center axis C of the blade. The hinge axis L is offset from center of gravity W of the blade for initial opening and final closing of the switch.

The key components with respect to the camming mechanism are the motion of a roller in a slot of a blade drive plate having opposite camming surfaces and the changing angle of the slot as the load builds against one of the camming surfaces. The roller is positioned lengthwise in the slot of the blade drive plate by a pre-set angle relative to a horizontal plane passing through the axis L of the switch blade contact terminals which horizontal plane is parallel with respect to the horizontal plane through which the lever moves to rotate the center insulator. The switch blade assembly resists easy rotation due to its center of gravity W being located off center of its axis of rotation, i.e., the hinge axis L creating a switch blade assembly rotation moment. The roller axis R of rotation always remains parallel to the axis of rotation L. The switch blade contact jaws eventually rotate to a predetermined fully closed angle relative to the horizontal plane passing through the hinge axis L.

The blade drive plate is driven against the roller proximate the slot by the rotation of the insulator imparted by the lever in the closing direction. The slot angle between the camming surface of the slot during closing of the switch and a line passing through the roller axis R and the hinge axis L starts at a predetermined angle to develop little force to drive the roller down the slot. As the force builds between the roller and the slot to overcome the blade rotation moment, the slot angle changes based on a spring positioned at the far end of the slot beginning to compress. The change of the slot angle gives direction to the heretofore stable roller driving it in a direction that starts to rotate the switch blade assembly about its hinge axis L. Once this roller motion starts it moves quickly because a large force has built up to drive the roller downward and any motion downward increases the angle of blade rollover lever relative to the to the slot thereby forcing even faster motion. This action results in a point of instability, i.e, a stable condition that quickly becomes unstable and releases the switch blade assembly to roll over.

The present invention provides for the point of instability being adjustable in two ways. The initial force of the spring can be adjusted by sizing the spring and its amount on compression and the initial angle of the slot can be adjusted by moving its stopping point.

Also, the invention provides a jam resistant double break disconnect switch because the increase in force between the roller and the slot due to, for example, ice accumulation in the break jaws, causes the initial angle of the slot to change (increase) a little more, thereby still releasing the roller to move downward in the slot. The increase in operating force necessary to apply to the lever in such conditions will therefore not be great since this mechanism is self regulating.

BRIEF DESCRIPTION OF THE DRAWINGS

For a better understanding of the invention reference may be made to the accompanying drawings exemplary of the invention, in which.

DETAILED DESCRIPTION OF THE INVENTION

Figure 1:
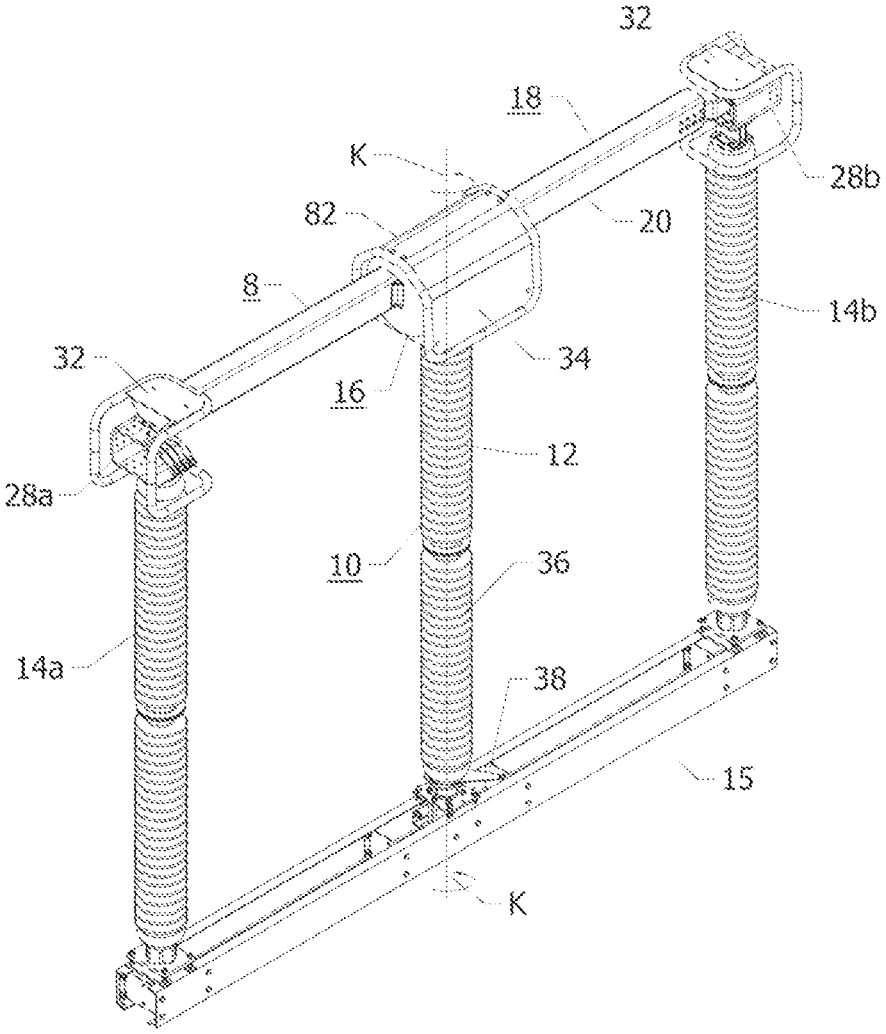
FIG. 1 is a perspective view of a double break disconnect switch of the present invention in the fully closed position.
Figure 2:
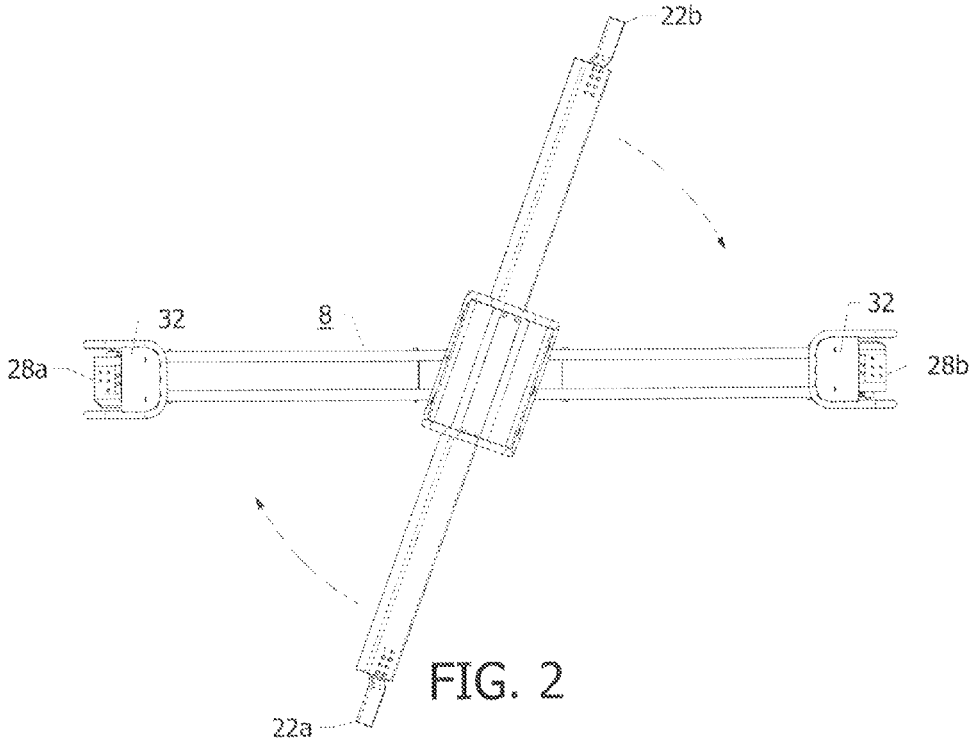
FIG. 2 is a plan view of the switch shown in FIG. 1 with the switch in the fully open position.
Figure 3:
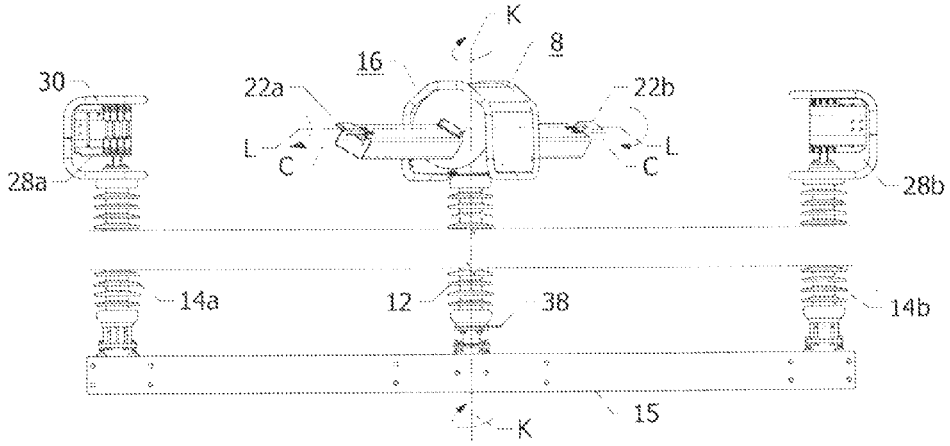
FIG. 3 is an elevation view of the switch shown in FIG. 2.
Figure 4:
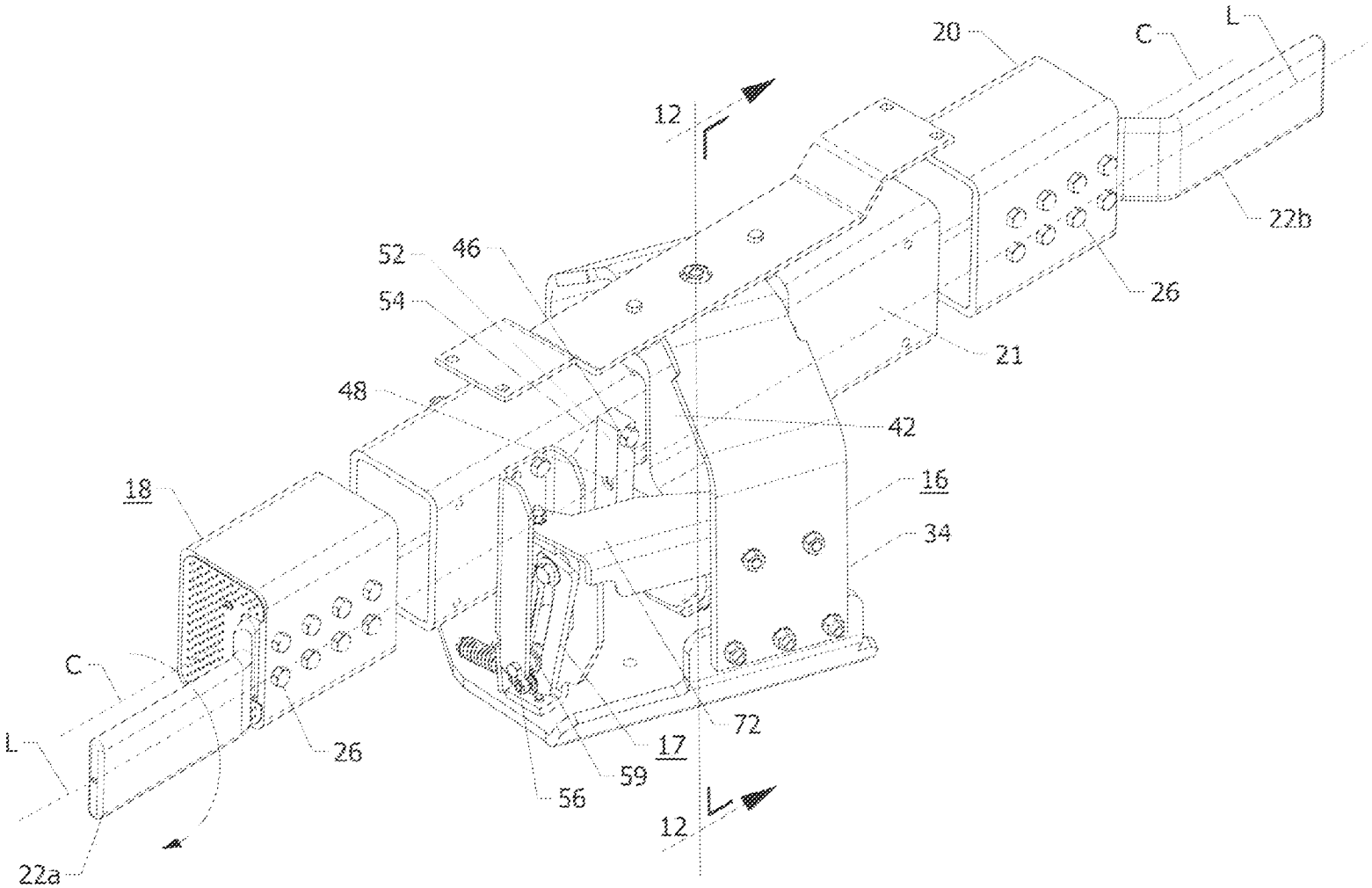
FIG. 4 is a perspective view of the switch blade assembly in the final closed position carried by the bearing arrangement with the weather cap removed.
Figure 5:
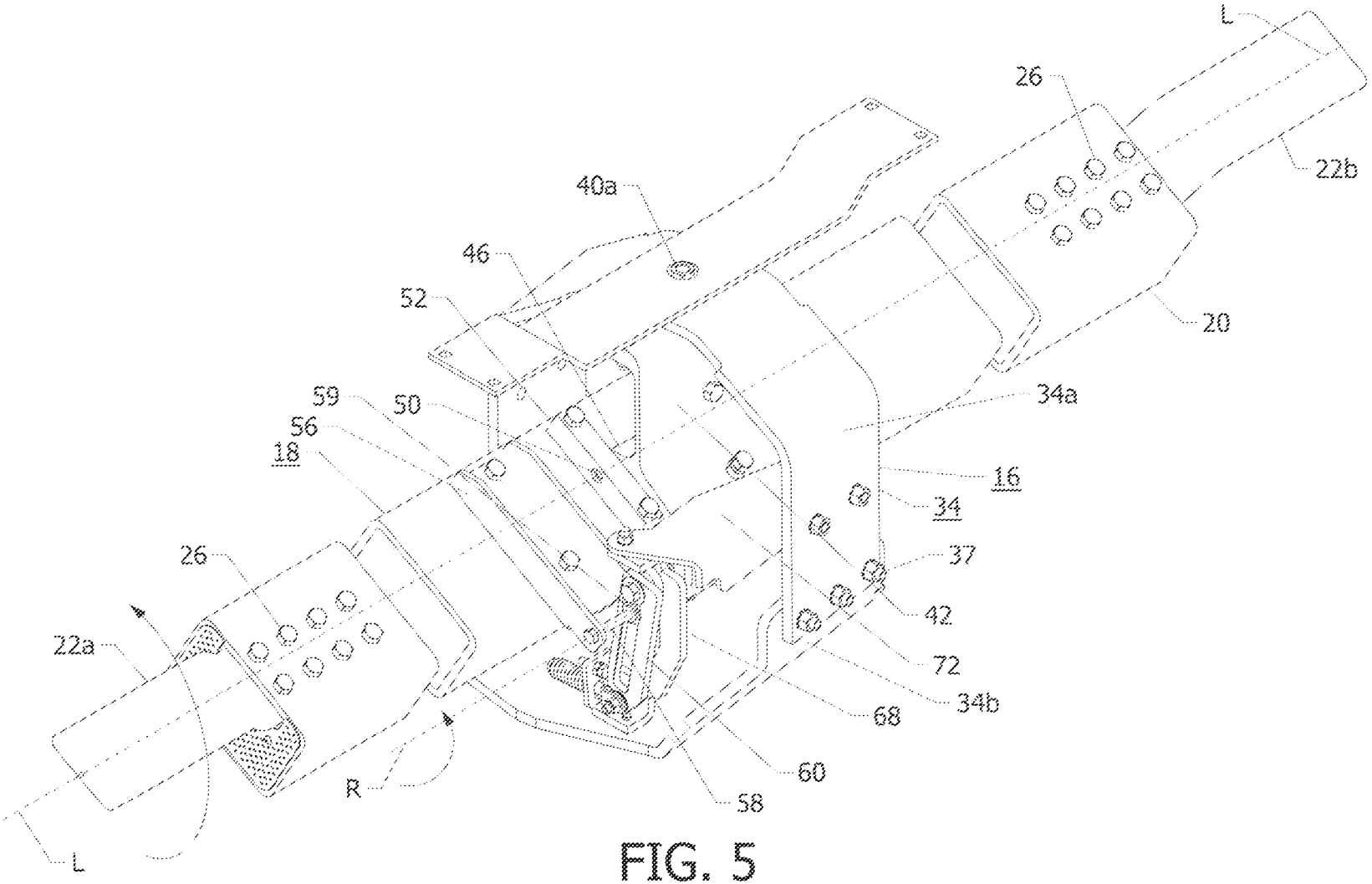
FIG. 5 is a perspective view of the switch blade assembly in the initially open position carried by the bearing arrangement with the weather cap removed.

With reference to FIGS. 1-3, a double break disconnect switch 8 for high voltage applications is shown comprising a drive arrangement 10 which includes a rotatable support assembly 36 including center rotatable insulator 12 and fixed insulators 14*a*, 14*b* and a lever 38 mounted to a base member 15. The supporting structure which includes the center rotatable insulator 12 and the fixed insulators 14*a*, 14*b* may be arranged as shown in FIG. 1 or may be in a split V configuration, not shown, for example. A bearing arrangement 16 is mounted on the drive arrangement 10 on the top of the rotatable insulators 12. The drive arrangement 10 is in relative movement relationship with respect to the bearing arrangement 16 via the lever 38. A switch blade assembly 18 includes a tubular switch blade 20 which may have a rectangular shape and be made of aluminum, for example. In FIGS. 4 and 5, the switch blade 20 has contact terminals 22*a*, 22*b*, i.e., blade tips attached to its ends. The switch blade 20 is heavy and may weigh 120 pounds and be 13 feet in length, for example. The contact terminals 22*a*, 22*b* may have an elongated flattened rectangular shape, such as shown in FIGS. 4 and 5 and be made of copper, for example. The switch blade assembly 18 is supported by the bearing arrangement 16 and rotatable about a hinge axis L of the tubular switch blade 20, as shown in FIGS. 4 and 5 and as subsequently described. The contact terminals 22*a*, 22*b* may be attached to the switch blade by a plurality of blade tip bolts 26.

Figure 13:
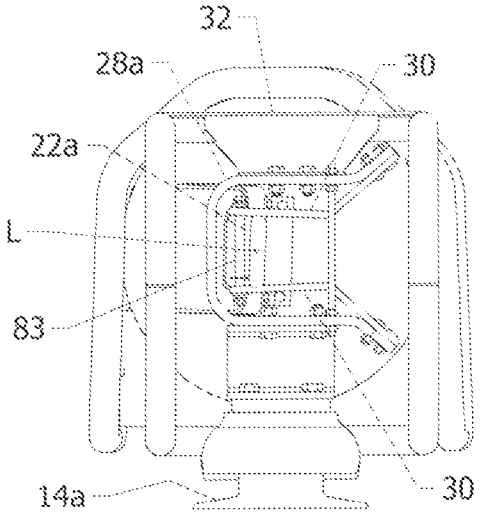
FIG. 13 is a left jaw end elevation view of the switch shown in FIG. 1 showing one of the blade contact terminals in the final closed position.
Figure 14:
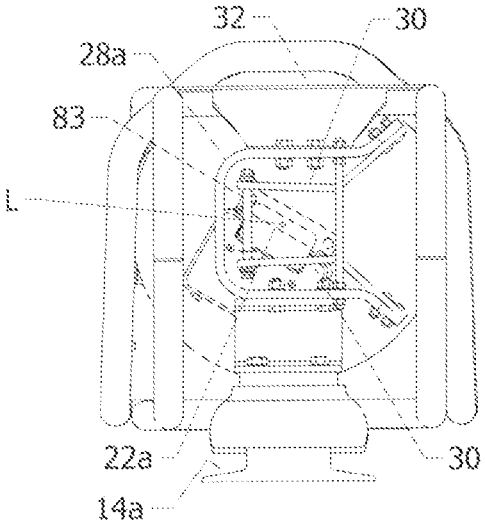
FIG. 14 is the same view as FIG. 13 but with the blade rotated to allow the blade to disengage from the jaw contacts; and, FIG. 15 is an elevation view of FIG. 6 showing schematically forces acting radius A and radius B.

The switch blade assembly 18 is caused to initially open the double break disconnect switch 8 and caused to finally close it with a longitudinal rotation with respect to hinge axis L such as shown in FIGS. 4 and 5. The switch blade assembly 18 is also arranged for a transverse macro swinging movement about axis K in opposite directions for final opening and initial closing of the double break disconnect switch 8, as shown in FIGS. 1-3. For receiving the contact terminals 22*a*, 22*b* at each end of the tubular switch blade 20 a pair of spaced resilient contact jaws 28*a*, 28*b* are provided for receiving each contact terminal 22*a*, 22*b*, as shown in FIGS. 1, 2, 13 and 14. Each contact terminal 22*a*, 22*b* is engageable with one of the contact jaws 28*a*, 28*b* in a pressure contact relationship during final closing of the switch blade assembly and disengageable from one of the contact jaws 28*a*, 28*b* when the switch blade assembly is initially opened. The switch jaws 28*a*, 28*b* are resilient enough to be spread apart slightly by the contact terminals 22*a*, 22*b* for placing the jaws 28*a*, 28*b* under tension to make good electrical contact. Jaws 28*a*, 28*b* include a plurality of oppositely disposed contacts 30, as shown in FIGS. 13 and 14. Preferably surrounding the jaws 28*a*, 28*b* is an ice shield 32. The jaws 28*a*, 28*b* are securely attached to respective fixed insulators 14*a*, 14*b*, as shown in FIGS. 1 and 3.

Figure 6:
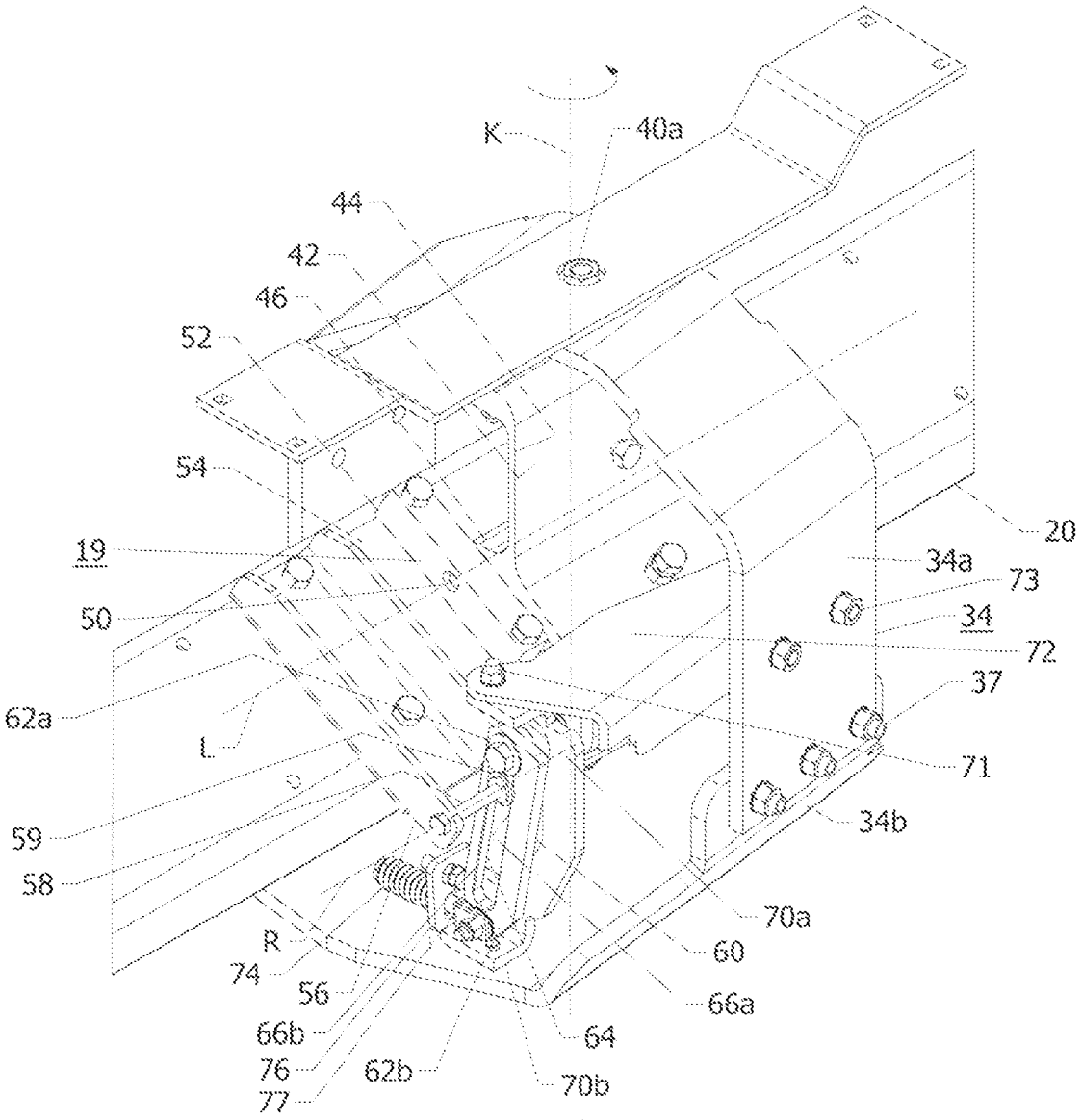
FIG. 6 is an enlarged perspective view of the bearing arrangement of FIG. 5 in operative position.
Figure 7:
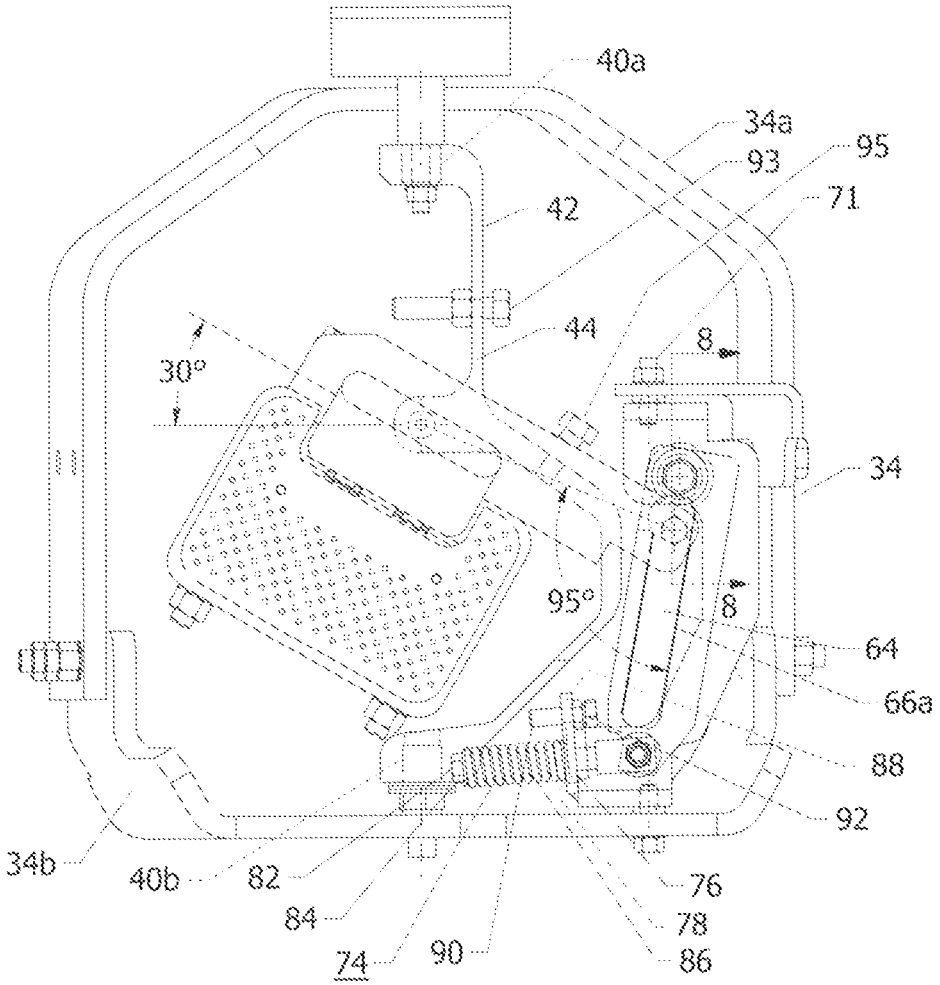
FIG. 7 is an end elevation view of the switch blade assembly with the switch in the fully open position with the weather cap removed and a slot angle of 95°.

The present invention provides that the bearing arrangement 16 includes a switch blade support member 34 mounted on the rotatable support assembly 36 for co-rotatable transverse movement during the transverse swinging movement of the switch blade 20 about axis K, as shown in FIG. 1. The bearing arrangement 16 includes a cam means 17 for imparting a rotational movement to the switch blade 20 with respect to hinge axis L. The bearing arrangement 16 includes means 19 for hinging the switch blade assembly 18 for rotation of the tubular switch blade 20 about the longitudinal hinge axis L which is offset from the longitudinal center of gravity W of blade 20 for initial opening and final closing of the double break disconnect switch, see FIGS. 4 and 12 for example. Each of the contact terminals 22*a*, 22*b* having a longitudinal axis that is collinear with the hinge axis L which is simply identified as axis L in the Figures. As shown in FIG. 6, the switch blade support member 34 may comprise an upper switch blade support member 34*a* and a base switch blade support member 34*b*. A plurality of switch blade support member bolt-nut combinations 37 connects the support members 34*a*, 34*b*. Also, as shown in FIG. 7, the switch blade support member 34 includes upper and lower pivot pins 40*a*, 40*b* for receiving and rotatably supporting a switch blade hinge bracket 42. The switch blade hinge bracket 42 is for rotatably supporting the tubular switch blade assembly 18 proximate the mid-point of the switch blade assembly, as shown in FIGS. 4-6. The switch blade hinge bracket 42 may have an E-shaped cross-section 44, such as shown in FIGS. 6 and 7.

As shown in FIGS. 6 and 7, the switch blade hinge bracket 42 proximate the mid-section 46 of the E-shaped cross-section 44 having an elongated transverse aperture 48 for receiving and holding a rod-shaped bearing 50 of predetermined diameter for supporting the switch blade assembly 18.

Figure 12:
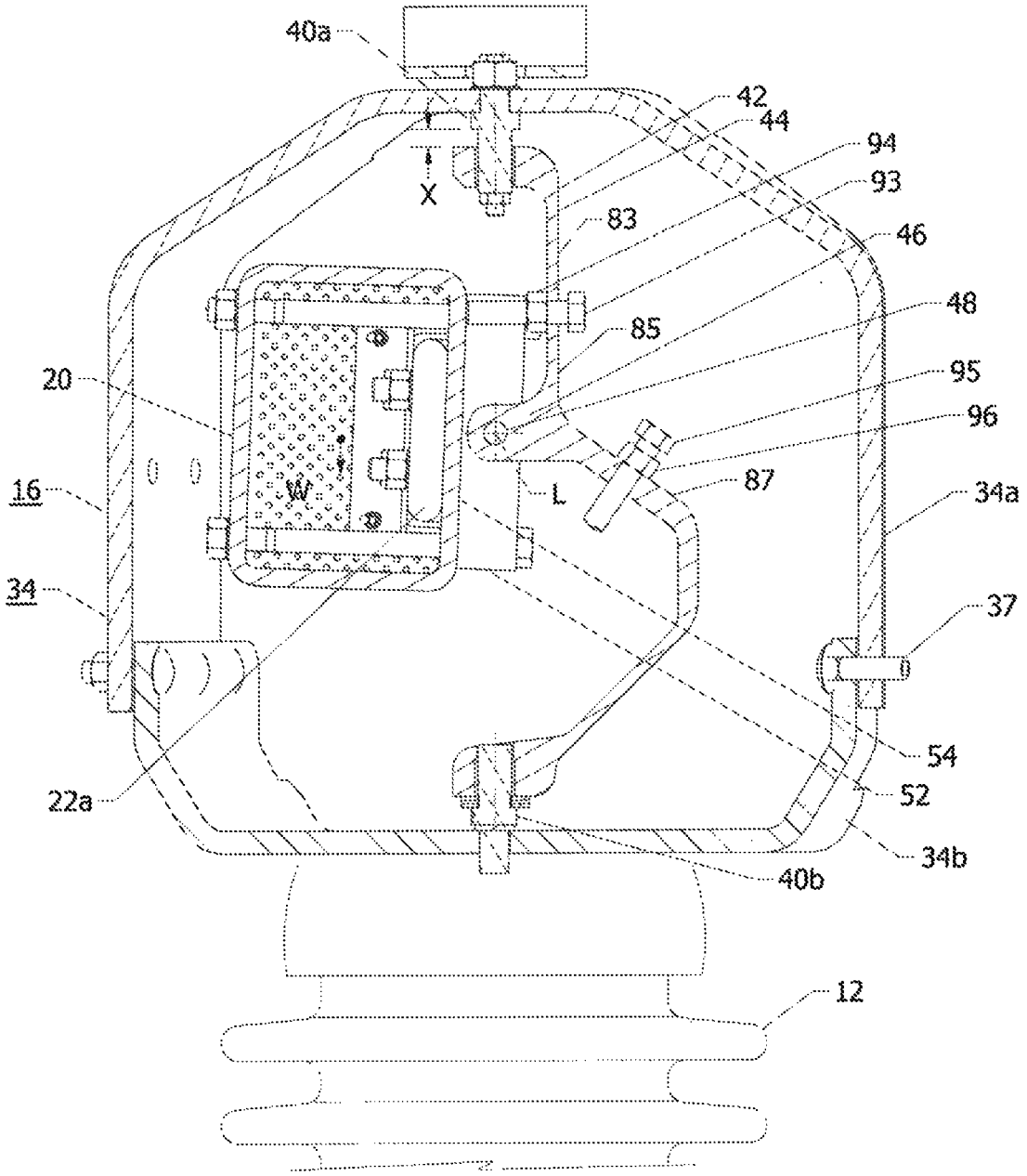
FIG. 12 is a cross section of the bearing arrangement in the operative position with the switch in the fully closed position with the weather cap removed taken along the line 12-12 of FIG. 4 mounted on the drive arrangement.
Figure 15:
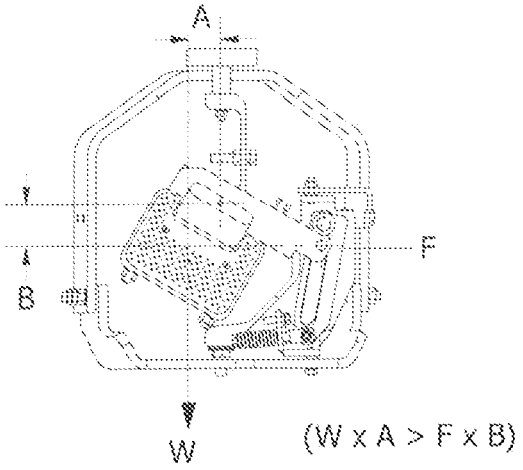

At least one switch blade bearing support attachment piece 52 is operably mounted to the rod-shaped bearing 50. The at least one switch blade bearing support attachment piece 52 is affixed to the outer surface 54 of the tubular switch blade 20; thus being offset from the center of gravity W of the tubular switch blade 20 for supporting the tubular switch blade, as shown in FIGS. 12 and 15. Most high voltage double break switches employ round tubular blades which rotate on their long i.e., longitudinal axis to achieve the necessary contact pressure developing or relieving ability. This means in most previous designs that the blade must have journal bearings larger in diameter than the blade conductor itself; and in effect encircle the switch blade. Therefore, this means that the frictional drag and the chance of jamming from contaminants increases as blade diameter increases because of the effective area of the journal bearings increasing. The present invention uses an off-center bearing location that is independent of the size of the blade therefore the bearing can be much smaller in diameter, thereby greatly reducing the friction and chances of jamming from contamination. The off-center location also provides another advantage in that the weight of the blade can now be used to return it to the open position once it is released from its fully closed position. Most if not all current designs require the use of a spring to develop this return to open function. As a blade with large bearings becomes contaminated and difficult to rotate, the spring which may have relaxed over time may not be enough to rotate it to its proper location. Incorrect operation is likely to happen, either incomplete closure and or difficult operation. The present invention using the rod shaped bearing 50 having very small bearing diameters and using unchanging gravitational force and will not suffer this fate. As the current rating of the switch blade increases to 4000 to 5000 amperes, the friction of a very large round diameter blade bearing encircling the blade becomes so high that the switch may not even be operable by manual means. In this situation the present invention is significant.

As shown in FIG. 12 the vertical bearing play of about 0.25 inches to about 0.50 inches at point X between the switch blade support member 34 and the hinge bracket 42 at the pins 40*a* and 40*b* allows the blade 20 to float vertically to seat in the contacts 28*a* and 28*b* equally as the switch closes, as shown in FIG. 3. This permits the blade assembly 18 to float to an equilibrium position vertically to balance the jaw contact 30 forces when the double break disconnect switch 8 is dosed. This further advantage of the present invention is the switch blade 20 can "float" to an equilibrium position vertically to balance out the forces on the jaw contacts 30 for optimum life of the contacts 30. An intermediary support member 42 can move up or down as needed to compensate for a switch which that does not have jaws 28*a*, 28*b* in exact alignment with the center insulator 12 and tubular switch blade 20. Previous switch designs with fixed bushing bearings aligning the blade have no ability to allow the blade to float to the equilibrium position which is accomplished in the present invention. Increased operating force, contact wear and possibly compromised short circuit capacity result from misalignment. Increased adjustment time during installation or readjustment during the life of the switch is necessary. The floating blade of the present invention eliminates this concern. The present invention provides a double break disconnect switch that is easy to install and operate and that will retain its like new operating characteristics for a very long time.

The novel mechanism of the present invention for rotating the blade 20 about L axis and axis K is now described. This mechanism is comprised of a cam means 17 including a pivot component 56 attached to blade 20 adjacent switch blade bearing support attachment piece 52. A blade guide pin 58 is operatively mounted to the switch pivot component 56. The blade guide pin 58 having an axis R extending parallel to the hinge axis L of the tubular switch blade 20. The blade guide pin 58 including a grooved roller 59 that is mounted rotatably on the guide pin 58 and slideable thereon. As insulator 12 in FIG. 3 is rotated on axis K to close the switch; a blade drive plate 60, in FIG. 6, pushes on pin 58 to cause blade 20 to also rotate on the K axis. The blade drive plate 60 has a proximal end 62*a* and a distal end 62*b*. The blade drive plate 60 having a slot 64 therein of predetermined dimensions, such as 0.80 inches×4.50 inches. The slot 64 is for operatively receiving and maintaining the grooved roller 59 in movable relationship with the blade guide pin 58. The drive plate 60 includes camming surfaces 66*a*, 66*b* next to and on opposite sides of the slot 64 for contacting the grooved roller 59 and pivots on hardware 63. A swiveling blade drive plate support bracket 68 includes upper and lower integral flange portions 70*a*, 70*b*. A cam means support bracket 72 is operatively attached by hardware (bolt-nut combination) 73 to the swiveling switch blade support bracket 68. The upper flange portion 70*a* of the swiveling drive blade support bracket 68 is operatively attached and in swiveling relationship with the cam means support bracket 72 by upper flange bolt-nut combination 71. The lower flange portion 70*b* of the swiveling drive blade support bracket 68 is operatively attached in swiveling relationship with the switch blade support member 34 by lower flange bolt-nut combination 75. A spring energy reservoir 74 is attached to the distal end 62*b* of the blade drive plate 60 for providing a predetermined opposing force in relation to the force applied by the roller 59 to the slot 64 of the blade drive plate 60.

Figure 10:
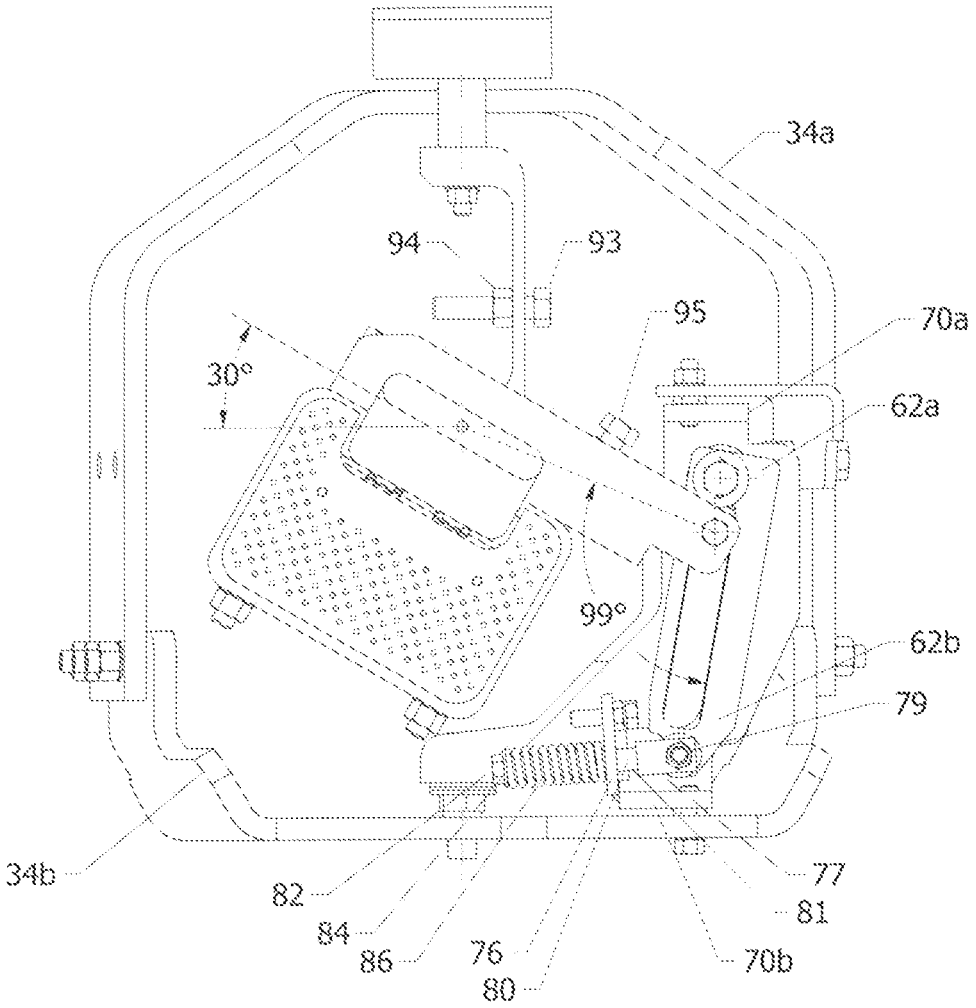
FIG. 10 is same view as FIG. 7 but with a slot angle of 99°.
Figure 11:
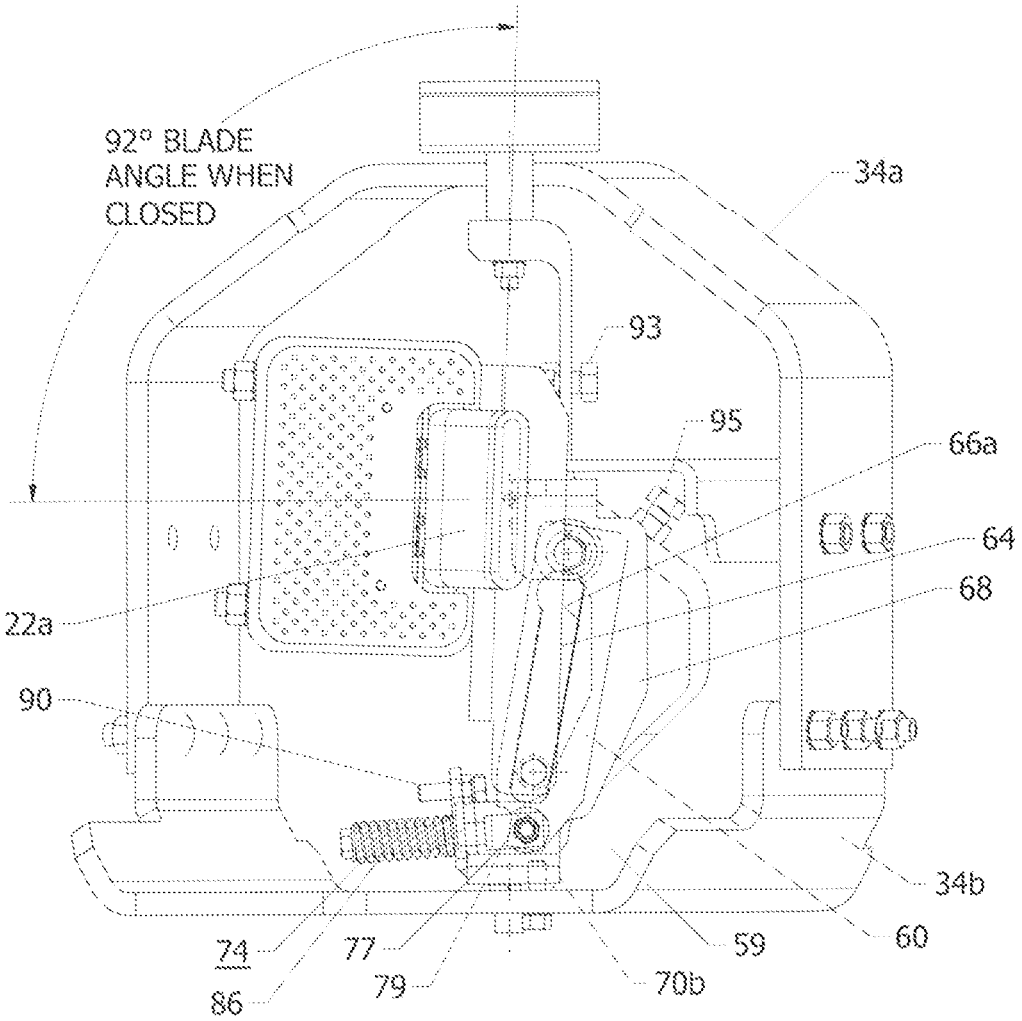
FIG. 11 is a perspective end view of the switch blade assembly showing the switch blade in the fully closed position with the blade tip at a 92° angle from the horizontal.

With reference to FIGS. 6, 7 and 10, the lower flange portion 70*b* of the swiveling drive blade support bracket 68 includes a substantially vertical extension portion 76. The substantially vertical extension portion 76 has a first extension portion aperture 78. The spring energy reservoir includes a rod member 80 operatively passing through the first extension aperture 78, shown by dashed lines in FIG. 7. The rod member 80 has a clevis member 77, see FIG. 10, operatively attached to the proximal end 81 thereof and the clevis member 77 is hinged to the distal end 62*b* of the blade drive plate 60 by clevis bolt-nut combination 79. The rod member 80 at the distal end 82 having a spring stop 84 attached. A helical compression spring 86 is mounted on the rod member 80 between the spring stop 84 and the vertical extension portion 76 of the lower flange portion 70*b*.

Figure 8:
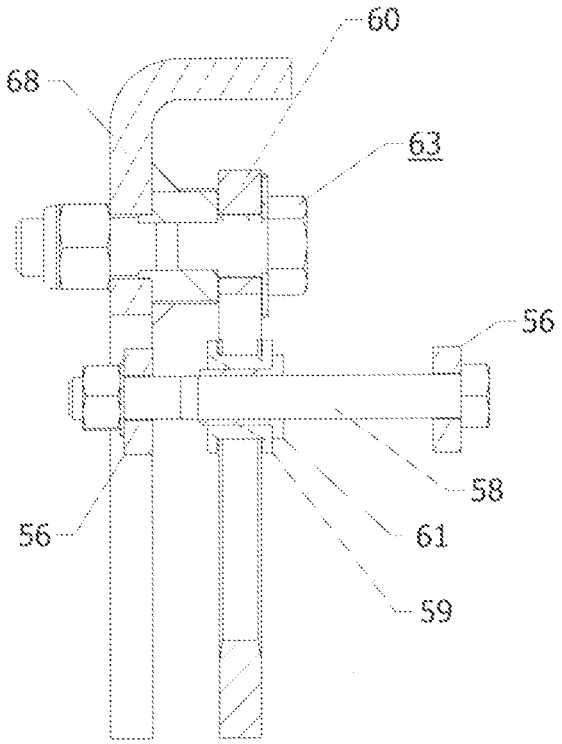
FIG. 8 is a cross section of a portion of the cam means taken along the line 8-8 of FIG. 7.

In the full open position of the switch blade assembly 18, as the lever 38 is turned, rotation of the insulator 12 causes the grooved roller 59 to exert a force on the blade drive plate 60 camming surface 66*a* next to the slot 64. The blade is caused by rotation of lever 38 to rotate transversely about the K axis so as to cause contacts 22*a* and 22*b* to enter jaw contacts 30 until the contacts 30 hit spacer 83 shown in FIG. 13. Continued rotation of insulator 12 causes the grooved roller 59 to exert a force on the camming surface 66*a* causing the angle of the slot to become more vertical, thereby compressing the helical spring 86 to such a degree that the increasing turning moment eventually overcomes the moment of the blade. This permits the blade guide pin 58 to suddenly be driven downward in the slot 64, thereby causing rotation of the blade and eventually full closing of the switch even with ice impediment. Preferably, the grooved roller 59 rides on a roller bearing 61, as shown most clearly in FIG. 8. As the blade 20 rotates about axis L as the pin 58 via roller 59 moves on the cam surface 66*a*, the blade open position of FIG. 5 is changed to the blade close position of FIG. 4 as well as FIG. 3 is changed to FIG. 1.

The vertical extension portion 76 is preferably provided with a threaded adjustable stop aperture 88 for receiving an adjustable stop member 90 which can be a threaded bolt, the head of which acts as a stop for the blade drive plate 60 as shown in FIG. 7 for example. A locking nut 92 engages the threaded bolt 90 so that the degree of movement of the blade drive plate 60 may be limited, thereby adjusting the slot angle when the switch blade 20 is in the fully open position.

As mentioned the motion of the roller 59 in the slot 64 and the changing angle of the camming surface 66*a* and the slot 64 as the load builds against the camming surface 66*a* is the key to the invention. The roller 59 is positioned to roll lengthwise in the slot 64 of the blade drive plate 60. When the switch is fully open the roller 59 is positioned in the upper end of the slot 64, as shown in FIG. 7. In the blade open position the switch blade contact terminals are set at a pre-set angle of 30 degrees relative to a horizontal plane passing through the axis L of the switch blade contact terminals, see FIG. 7, which horizontal plane is parallel with respect to the horizontal plane through which the lever 38 moves to rotate the center rotatable insulator 12. As stated, the switch blade assembly 18 resists easy rotation due to its center of gravity W being located off center of its axis of rotation, i.e., the hinge axis L, creating a switch blade assembly rotation moment. The roller axis R of rotation always remains parallel to the axis of rotation L. The switch blade contact terminals 22*a*, 22*b* eventually rotate to a predetermined fully closed angle relative to the horizontal plane passing through the hinge axis L. The angle between the slot 64 and an imaginary line through the roller and blade rotation axes starts at a typical value of 95 degrees, such as shown in FIG. 7. As the force builds between the roller 59 and the camming surface 66*a* of the blade drive plate 60 to overcome the blade rotation moment, the angle of slot 64 changes based on the spring 86 positioned at the far end of slot 64 beginning to compress, see FIG. 10 where the angle between the slot 64 and an imaginary line through the roller and blade rotation axes now becomes 99 degrees, i.e, the slot 64 becomes more vertical. This angular change gives direction to the heretofore stable roller 59 driving it in a direction (downward) that starts to rotate the blade about the axis L. Thus, this action results in a stable condition that becomes unstable (point of instability) and releases the blade to allow rollover. Now that the blade has been released to rotate about the L axis, the roller 59 easily travels down the slot 64. This motion increases the effective moment arm of the blade rollover lever 38, increasing the rollover force developed by the rotating insulator 12 pushing the slot 64 until rollover is reached at 92 degrees, as shown in FIG. 10.

Figure 9:
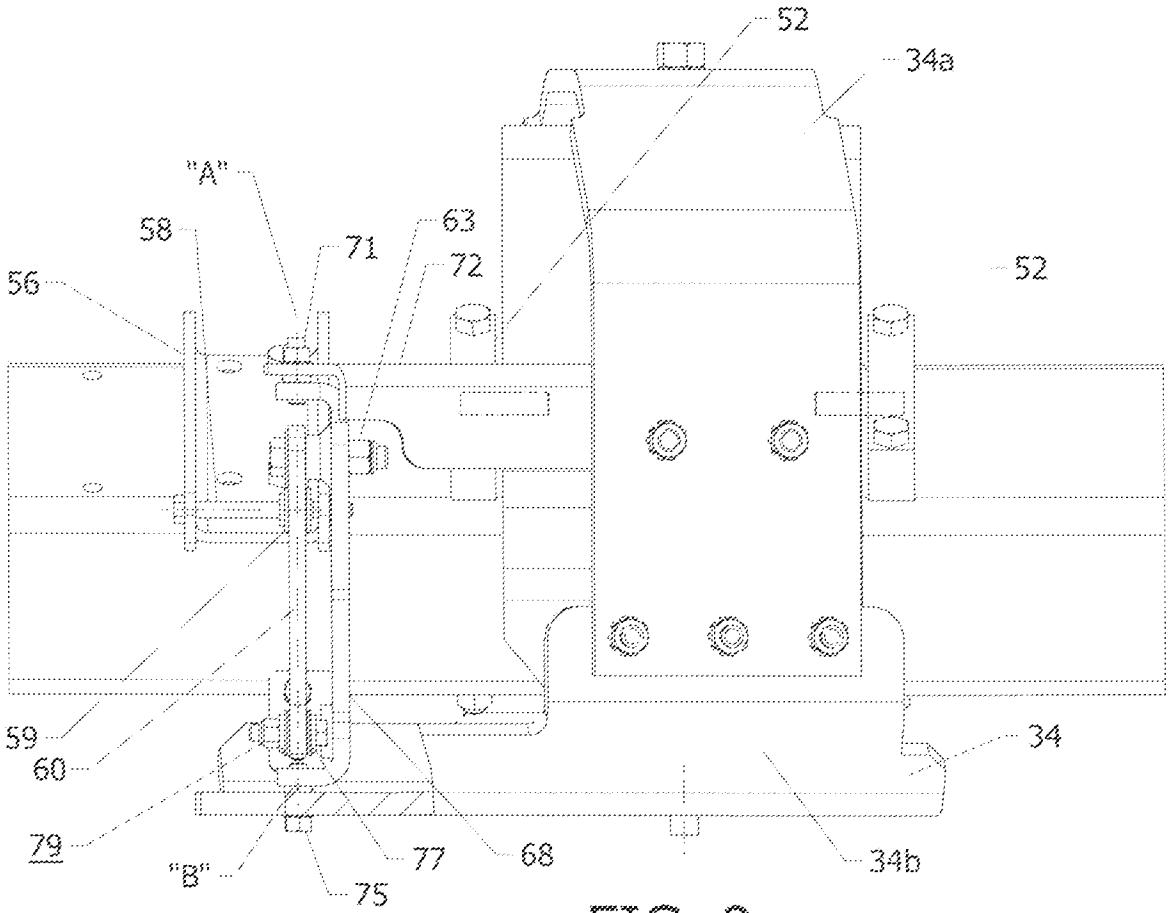
FIG. 9 is a side elevation view partially broken away of the bearing arrangement with the switch in the fully open position with the weather cap removed.

Rotation of the blade during final closing is on an axis perpendicular to the rotation of the center rotatable insulator 12. In order for this motion to proceed without binding and high wear, the blade drive plate 60 is held on a rotatable axis parallel to the insulator axis by the swiveling drive blade support bracket 68. The blade drive plate 60 pivots at Points "A" and "B" as shown in FIG. 9. This degree of freedom causes the roller 59 and the slot 64 to engage in a parallel fashion, making the motion and transfer of forces smooth and efficient. The swiveling drive blade support bracket 68 also guides spring 86 in relationship to the blade drive plate 60.

The point of instability is adjustable in two ways. The initial force of the spring can be adjusted by sizing the spring and its amount of compression and the initial angle of the slot 64 in the fully open position of the switch blade can be adjusted by moving its stopping point via adjusting the adjustable stop member 90. Increasing the spring force will increase the force required to reach the point of instability. Adjusting the angle of slot 64 relative to the switchblade pivot component 56, i.e, relative to an imaginary line taken from the axis L to the axis of the blade guide pin 58 from near 95 degrees to less than 95 degree when the blade is in the full open position will increase the force required to reach the point of instability. As mentioned this release force is directly proportional to the force applied to the resilient contact jaws 28*a*, 28*b* by the contact terminals 22*a*, 22*b* when entering the contact jaws (break jaws) during closing. As discussed previously, over time, friction may increase from the initial factory value, causing the release force to increase. A big advantage of the release mechanism of the present invention is that it resists jamming. The increase in force between the roller 59 and slot 64 will change the angle of the slot a little more, thereby still releasing the roller 59 to move downward in the slot 59. The change in operating force will not be great since this mechanism is self regulating.

During opening, the slot 64 is moved in the opposite direction by rotation of the center rotatable insulator 12. The camming surface 66*b* at the slot 64 will pull on the roller 59 to rotate the blades out of the contact jaws 28*a*, 28*b*. Once the rotation has gone far enough to release contact pressure, the blade rotates in a free fall fashion to its full open 30 degree angle. The roller 59 travels up the slot and is ready for the next close operation.

Referring to FIGS. 7, 10, 11 and 12 the switch blade hinge bracket 42 includes at an upper portion 83 of the E-shaped cross-section 44 a substantially vertical wall 85. A first switch blade stop bolt 93 and cooperating nut 94 is affixed to the vertical wall 85 for preventing further rotation of the tubular switch blade 20 in an adjustable manner when the blade is fully dosed. The switch blade hinge bracket 42 includes at a lower portion 87 of the E-shaped cross-section 44 a second switch blade stop bolt 95 and cooperating nut 96 is attached to the lower portion 87 for preventing further rotation of the tubular switch blade 20 in an adjustable manner when the blade is fully opened. The switch blade hinge bracket 42 is in pivotable arrangement with respect to the switch blade support member 34 for permitting rotation of the switch blade about the hinge axis L as force is applied to the blade guide pin 58.

What is claimed is:

1. A double break disconnect switch comprising:

a drive arrangement including a rotatable support assembly including at least one rotatable insulator and a lever for imparting rotation to the at least one rotatable insulator, a bearing arrangement mounted on the drive arrangement, said drive arrangement via the lever in relative movement relationship with respect to the bearing arrangement, a switch blade assembly including a switch blade supported by the bearing arrangement and rotatable with respect to the longitudinal axis thereof for initial opening of the double break disconnect switch and for final closing of the double break disconnect switch and the switch blade assembly arranged for a transverse swinging movement for final opening and initial closing of the double break disconnect switch, a contact terminal affixed at each end of said switch blade, a pair of spaced resilient contact jaws for receiving each contact terminal, each contact terminal engageable with one of the contact jaws in a pressure contact relationship during final closing of the switch blade assembly and disengageable from one of the contact jaws when the switch blade assembly is initially opened, the bearing arrangement including means for hinging the switch blade assembly for rotation of the switch blade with a predetermined minimum torque about a hinge axis positioned outside the outer surface of the switch blade and parallel to the longitudinal center axis of the switch blade and offset from the center of gravity of the switch blade assembly for initial opening of the double break disconnect switch and for final closing of the double break disconnect switch, the bearing arrangement including a switch blade support member mounted on the rotatable support assembly for co-rotatable transverse movement therewith during the transverse swinging movement of the switch blade, the bearing arrangement including a cam means for imparting the transverse swinging movement to the switch blade assembly and for imparting a rotational movement thereto with respect to the hinge axis of the switch blade during final closing or initial opening of the double break disconnect switch, the cam means including a switch blade pivot component affixed to the switch blade in predetermined position offset from the at least one switch blade bearing support attachment piece, a blade guide pin operatively mounted to the switch blade pivot component, the blade guide pin having an axis extending parallel to the longitudinal axis of the switch blade, the blade guide pin including a grooved roller mounted in rotatable and slidable relationship therewith, a blade drive plate having a proximal end and distal end, the blade drive plate including a slot therein for receiving and maintaining the grooved roller of the blade guide pin in movable relationship therewith, the blade drive plate including camming surfaces proximate opposite sides of the slot for contacting the grooved roller, a swiveling blade drive plate support bracket including upper and lower flange portions, a cam means support bracket operatively affixed to the switch blade support member, the upper flange portion of the swiveling blade drive blade support bracket operatively attached to and in swiveling relationship with the cam means support bracket, the lower flange portion of the swiveling drive blade support bracket operatively attached to and in swiveling relationship with the switch blade support member, a spring energy reservoir for providing a predetermined opposing force in relation to the roller and the camming surfaces of the blade drive plate, the spring energy reservoir in operative attachment with the distal end of the blade drive plate, each of the contact terminals having a longitudinal axis that is collinear with the hinge axis.

2. The double break disconnect switch of claim 1, wherein the means for hinging the switch blade assembly for rotation of the blade about the hinge axis of the switch blade comprises:

the switch blade support member including upper and lower vertical pivot pins for receiving and rotatably supporting a switch blade hinge bracket therebetween, the switch blade hinge bracket proximate the mid-section thereof having an elongated transverse aperture for receiving and holding a relatively small diameter rod-shaped bearing for supporting the switch blade assembly, at least one switch blade bearing support attachment piece operably mounted to the rod-shaped bearing, the at least one switch blade bearing support attachment piece affixed to the outer surface of the switch blade for supporting the tubular switch blade.

3. The double break disconnect switch of claim 2, wherein the lower flange portion of the swiveling blade drive plate support member includes a substantially vertical extension portion having an aperture therethrough, the spring energy reservoir includes a rod member operatively hinged to the distal end of the blade drive plate and slideably passing through the aperture of the a substantially vertical extension portion, the rod at the distal end thereof having a spring stop operatively affixed thereto, a helical spring surrounding the rod member between the spring stop and the substantially vertical extension portion of the lower flange portion of the swiveling blade drive plate support member, whereby as the lever is turned transversely to close said double break disconnect switch and upon the contact jaws contacting the pair of spaced resilient contact jaws, the grooved roller exerts a force on one of the blade drive plate camming surfaces proximate the slot, thereby causing the angle of the slot to become more vertical thereby compressing the spring to such a degree as the spring force overcomes the force exerted between the roller and the slot thereby permitting the blade guide pin and roller to suddenly be driven downward in the slot permitting full closing of the double break disconnect switch.

4. The double break disconnect switch of claim 3, the spring energy reservoir includes an adjustable stop member affixed to the vertical extension portion of the lower flange for operatively contacting the blade drive plate, the adjustable stop member for adjusting the initial angle of the slot when the double break disconnect switch is fully open where the initial angle is the angle between one of the camming surfaces proximate the slot relative to an imaginary line passing through the axis of the rod-shaped bearing and the blade guide pin.

5. The double break disconnect switch of claim 4, further including a bushing bearing for carrying the grooved roller on the blade guide pin, whereby friction components between the grooved roller and the blade guide pin are substantially reduced.

6. The double break disconnect switch of claim 1, wherein the predetermined minimum torque to rotate the switch blade about the hinge axis offset from the switch blade assembly center of gravity is greater than the torque to rotate the switch blade assembly transversely about the rotating insulator axis, thereby providing an impedance to rotation of the switch blade assembly with respect to the hinge axis for ensuring that the blade contact terminals fully enter the jaw contacts before rotation of the switch blade into full connection with the jaw contacts.

7. The double break disconnect switch of claim 2, wherein the blade support member is dimensioned to allow vertical movement of the hinge bracket at the pivot pins, thereby permitting the blade assembly to float to an equilibrium position vertically to balance contact forces between the blade contact terminals and the jaw contacts.

8. The double break disconnect switch of claim 2, wherein the rod-shaped bearing has a diameter of from about 0.5 inches to about 1.0 inches, thereby reducing friction.

9. The double break disconnect switch of claim 2, wherein the switch blade hinge bracket includes a first switch blade stop bolt to control the final close rotation of the switch blade and a second switch blade stop bolt to control the final open rotation of the switch blade with respect to its longitudinal axis.

10. The double break disconnect switch of claim 1, further comprising a weather cap affixed to the top of the switch blade support for protecting the bearing arrangement against environmental elements and excluding the nesting of birds.

11. The double break disconnect switch of claim 7, wherein the switch blade hinge bracket is permitted to float with respect to its vertical axis from about 0.25 inches to about 0.50 inches.

12. The double break disconnect switch of claim 3, wherein each of the resilient contact jaws includes a spacer bumper for contacting one of the contact terminals for initiating one of the camming surfaces to apply a force to the blade guide pin for causing the switch blade rotation about the hinge axis.

13. The double break disconnect switch of claim 11, wherein the switch blade hinge bracket is in pivotable arrangement with respect to the switch blade support member for permitting rotation of the switch blade about the hinge axis as force is applied to the blade guide pin.

14. The double break disconnect switch of claim 13, wherein during final closing of the disconnect switch the vertical distance between two horizontal imaginary lines, one of said horizontal imaginary lines passing through the hinge axis and the other of said horizontal imaginary lines passing through the blade guide pin axis, grows as the blade rotates thereby reducing the force needed to overcome the increasing frictional force created from the engagement of the contact terminals and contact jaws.

* * * * *